US008013811B2

(12) United States Patent
Akimoto et al.

(10) Patent No.: US 8,013,811 B2
(45) Date of Patent: Sep. 6, 2011

(54) IMAGE DISPLAY DEVICE

(75) Inventors: Hajime Akimoto, Ome (JP); Takahiro Nagano, Hitachi (JP); Takeo Shiba, Kodaira (JP)

(73) Assignee: Hitachi Displays, Ltd., Chiba (JP)

( * ) Notice: Subject to any disclaimer, the term of this patent is extended or adjusted under 35 U.S.C. 154(b) by 803 days.

(21) Appl. No.: 12/005,318

(22) Filed: Dec. 27, 2007

(65) Prior Publication Data

US 2008/0122763 A1 May 29, 2008

Related U.S. Application Data

(62) Division of application No. 10/340,615, filed on Jan. 13, 2003, now Pat. No. 7,336,247.

(30) Foreign Application Priority Data

Apr. 17, 2002 (JP) ..... P2002-114119

(51) Int. Cl.
*G09G 3/30* (2006.01)

(52) U.S. Cl. ..... 345/76; 345/45; 345/77; 345/89; 345/690; 315/169.1; 315/169.3

(58) Field of Classification Search ..... 345/204, 345/45, 76–100, 690, 55; 315/169.1–169.4
See application file for complete search history.

(56) References Cited

U.S. PATENT DOCUMENTS 5,812,105 A 9/1998 Van de Ven
6,323,871 B1 11/2001 Fujiyoshi et al.
6,501,227 B1 12/2002 Koyama
6,583,775 B1 6/2003 Sekiya et al.
6,617,799 B2 * 9/2003 Koyama ..... 315/169.3
6,618,031 B1 9/2003 Bohn, Jr. et al.

(Continued)

FOREIGN PATENT DOCUMENTS

GB 2320790 A 12/1997

(Continued)

OTHER PUBLICATIONS

An Office Action from Japanese Patent Office dated Dec. 2, 2008 regarding Japanese Patent Application No. P2007-259365, in Japanese with English translation.

(Continued)

*Primary Examiner* — Quan-Zhen Wang
*Assistant Examiner* — Jennifer Nguyen
(74) *Attorney, Agent, or Firm* — Stites & Harbison PLLC; Juan Carlos A. Marquez, Esq.

(57) ABSTRACT

An image display device incorporates a group of pixels of two or more types, each pixel including a light source whose primary wavelength is specific to the type of pixel; a generating device for generating analog pixel signals to be input to the group of pixels from input digital pixel data, wherein the generating device has a converter to convert input digital pixel data into different output digital pixel data appropriate for each type of pixel where the output digital pixel data contains more bits than the input digital pixel data; and an input device for inputting the analog pixel signals to the group of pixels, each pixel including a light emission driver for driving the light source according to the analog pixel signal. An organic EL display device having individual R, G, and B light emission elements enables displaying in desired colors and controllable tones with reduced packaging area for the components of the organic EL display.

7 Claims, 14 Drawing Sheets

U.S. PATENT DOCUMENTS

| | | | | |
|---|---|---|---|---|
| 6,672,722 | B2 | 1/2004 | O'Connor et al. | |
| 6,911,960 | B1 * | 6/2005 | Yokoyama | 345/76 |
| 6,943,760 | B2 * | 9/2005 | Bae et al. | 345/76 |
| 6,952,194 | B1 * | 10/2005 | Yamazaki et al. | 345/92 |
| 7,221,337 | B1 * | 5/2007 | Choi et al. | 345/76 |
| 2002/0149556 | A1 * | 10/2002 | Matsueda | 345/98 |
| 2002/0186183 | A1 * | 12/2002 | Akimoto | 345/55 |
| 2003/0016200 | A1 | 1/2003 | Hashimoto | |

FOREIGN PATENT DOCUMENTS

| | | |
|---|---|---|
| JP | 11-45072 | 7/1997 |
| JP | 10-293285 | 12/1997 |
| JP | 2000-056732 | 8/1998 |
| JP | 2001-142427 | 11/1999 |
| JP | 2001-60076 | 6/2000 |
| JP | 2002-32058 | 7/2000 |
| JP | 2001-159878 | 9/2000 |
| WO | WO 0199195 | 6/2001 |

OTHER PUBLICATIONS

Yoshiharu Nakajima, Maoshi Goto, Hideo Kataoka, and Toshikazu Maekawa, "A 3.8 Inch QVGA Reflective Color LCD with Integrated 3b DAC Driver," 2000 IEEE Internatinoal Solid-State Circuits Conference, pp. 188-189.

* cited by examiner

| INPUT DATA=LIGHT EMISSION VALUE OF TONE | | | SIGNAL VOLTAGE VALUE OF TONE |
|---|---|---|---|
| B | B | B | |
| | | | 000 |
| 00 | | | 001 |
| | | | 010 |
| 01 | 00 | 00 | 011 |
| | 01 | | 100 |
| 10 | 10 | 01 | 101 |
| | 11 | 10 | 110 |
| 11 | | 11 | 111 |

IMAGE DISPLAY DEVICE

CROSS REFERENCE TO RELATED APPLICATIONS

This application is a Divisional of U.S. patent application Ser. No. 10/340,615, filed Jan. 13, 2003 now U.S. Pat. No. 7,336,247. Priority is claimed based on U.S. patent application Ser. No. 10/340,615, filed Jan. 13, 2003, which claims priority to Japanese Patent Application No. 2002-114119 filed on Apr. 17, 2002, and which is hereby incorporated by reference.

BACKGROUND OF THE INVENTION

1. Field of the Invention

The present invention relates to an image display device capable of high-quality color display and, more particularly, to an image display device that can be downsized, using pixel drive electronics circuitry built into a compact package area.

2. Description of the Related Art

Referring to FIG. 15, a typical prior-art display device is described below.

In recent years, studies of so-called organic electroluminescent (EL) displays using organic EL (also referred to as Organic Light Emitting Diode (OLED) elements have been vigorously pursued. However, if the aim of the organic EL display method is light emission in full colors and tones, ideally, all organic EL elements corresponding to R, G, and B colors of light emission must carry separate drive currents to represent tones in order to obtain given luminance with given chromaticity because the organic EL elements for R, G, and B have different optical light emission characteristics. In consequence, when driving the R, G, and B pixels simply by a single drive circuit, like the drive circuit for conventional liquid crystal displays, the problem arises that desired colors cannot be reproduced or the tones are hard to control.

FIG. 15 is a diagram representing a schematic circuitry structure of a simple-matrix-type organic EL display which has been proposed to avoid the above problem.

On the substrate 201, organic EL elements 202 are arranged in a matrix and connected to a plurality of data lines 203. R, G, and B organic EL elements 202 are connected to corresponding R, G, and B data lines 203. The R, G, and B data lines 203 on one end thereof are connected to corresponding R, G, and B tap electrodes 204. The R, G, and B tap electrodes 204 are connected to organic EL drive circuits for R, G, and B colors, respectively, via the lines reconnection means 205. The lines reconnection means 205 is a multilevel interconnection board built, using a plastic-molded multilayer buildup substrate, and having the duty of connecting the R, G, and B tap electrodes 204 to the organic EL drive circuits 206 for R, G, and B colors.

The operation of this example of a prior-art display device is next briefly described. When a row of organic EL elements 202 that will be driven to emit light is selected by a scan-by-the-row circuit (not shown), corresponding pixel data signals are input from the organic EL drive circuits 206 through the data lines 203 to the organic EL elements 202 in the row. Then, the organic EL elements 202 in the selected row emit light, according to the pixel data signals. In this way, scanning each row and inputting pixel data signals to the organic EL elements in the row are repeated and thereby the organic EL display presents an image. In this prior-art display device, the introduction of the lines reconnection means 205 makes it possible to drive the R, G, and B organic EL elements separately by the organic EL drive circuits 206 for R, G, and B colors and the above-noted problem can be avoided. JP-A No. 56732/2000 describes the above prior-art display device in detail.

In the sphere of small and medium size crystal displays, a technique for building an analog signal drive circuit using polycrystalline Si-TFTs (Thin Film Transistors) together with pixels on a same glass substrate is now being developed. This technique is expected to reduce the cost of the analog signal drive circuit and improve the impact-resistant reliability of the display. In such technique, the analog signal drive circuit comprises shift registers, latch circuits, D-A converter, and other circuits. This technique is described in detail in, for example, Proceedings of 2000 IEEE International Solid-State Circuits Conference (ISSCC 2000), pp. 188-189.

If the organic EL display can be constructed by building the above-mentioned prior art analog signal drive circuit using polycrystalline Si-TFTs together with pixels on the same glass substrate, cost reduction and improved impact-resistant reliability of the display would be expected similarly. For the organic EL display, however, ideally, it is necessary to supply separate drive currents to represent tones to the organic EL elements of R, G, and B colors, as noted above. Therefore, when building an analog signal drive circuitry on a glass substrate like the above-mentioned prior art liquid crystal displays, separate analog signal drive circuits for R, G, and B colors must be built. In consequence, even if the above-mentioned lines reconnection means is used, the area of the analog signal drive circuits becomes three times the corresponding area in the case of a liquid crystal display. This will be obstructive to downsizing the display device, taking the packaging area for the components of the organic EL display into consideration.

Although the above discussion assumed that the analog signal drive circuits using polycrystalline Si-TFTs are built together with pixels on the same glass substrate, even if these circuits are built, respectively, on monocrystalline LSIs, three drive circuit LSIs are mounted to the display. This is obviously disadvantageous in view of the packaging area and the same problem exists.

SUMMARY OF THE INVENTION

According to at least one preferred embodiment of the present invention, a smaller image display device that enables display in desired colors and controllable tones can be provided with reduced packaging area for the components of the organic EL display.

An image display device, according to one preferred embodiment of the present invention, comprises a display portion which comprises a group of pixels of two or more types, each pixel including means for emitting light whose primary wavelength is specific to the type of the pixel; means for generating analog pixel signals to be input to the group of pixels from digital pixel data which is input thereto; means for inputting the analog pixel signals to the group of pixels, each pixel including light emission driving means for driving said means for emitting light, according to the analog pixel signal input to the pixel; and means for converting digital pixel data into corresponding pixel data consisting of more bits than the input pixel data thereto. The means for converting digital pixel data connects to the input end of the means for generating analog pixel signals and is able to convert the same input digital pixel data into different output digital pixel data appropriate for each type of pixel having the means for emitting light, whose primary wavelength is specific to the type of the pixel.

An image display device according to another preferred embodiment of the present invention comprises: a display portion which comprises a group of pixels of two or more types, each pixel including means for emitting light whose primary wavelength is specific to the type of pixel; means for generating analog pixel signals to be input to the group of pixels from digital pixel data which is input thereto; and means for inputting the analog pixel signals to the group of pixels, each pixel including light emission driving means for driving said means for emitting light, according to the analog pixel signal input to the pixel, wherein the means for generating analog pixel signals is able to generate, from the same digital pixel data, different analog pixel signals to be supplied to each type of pixel having the means for emitting light, whose primary wavelength is specific to the type of the pixel.

An image display device according to a further preferred embodiment of the present invention comprises: a display portion which comprises a group of pixels of two or more types, each pixel including means for emitting light whose primary wavelength is specific to the type of pixel; means for generating analog pixel signals to be input to the group of pixels from digital pixel data which is input thereto; and means for inputting the analog pixel signals to the group of pixels, each pixel including light emission driving means for driving said means for emitting light, according to the analog pixel signal input to the pixel, wherein the light emission driving means is able to drive, from an analog pixel signal, said means for emitting light with a drive current out of different currents appropriate for each type of pixel having the means for emitting light, whose primary wavelength is specific to the type of the pixel.

An image display device according to yet a further preferred embodiment of the present invention comprises: a display portion which comprises a group of pixels of two or more types, each pixel including means for emitting light whose primary wavelength is specific to the type of pixel; means for generating analog pixel signals to be input to the group of pixels from digital pixel data which is input thereto; and means for inputting the analog pixel signals to the group of pixels, each pixel including light emission driving means for driving said means for emitting light, according to the analog pixel signal input to the pixel, wherein the light emission driving means is able to drive the means for emitting light for a period out of different periods appropriate for each type of pixel having the means for emitting light, whose primary wavelength is specific to the type of the pixel.

An image display device according to yet another preferred embodiment of the present invention comprises: a display portion which comprises a group of pixels of two or more types, each pixel including means for emitting light whose primary wavelength is specific to the type of pixel; image signal processing means for generating digital pixel data; means for generating analog pixel signals to be input to the group of pixels from the digital pixel data which is input thereto; and means for inputting the analog pixel signals to the group of pixels, each pixel including light emission driving means for driving said means for emitting light, according to the analog pixel signal input to the pixel, wherein the image signal processing means is made to convert the same digital pixel data into different output digital pixel data consisting of more bits than the input pixel data and appropriate for each type of pixel having the means for emitting light, whose primary wavelength is specific to the type of the pixel.

BRIEF DESCRIPTION OF THE DRAWINGS

For the present invention to be clearly understood and readily practiced, the present invention will be described in conjunction with the following figures, wherein like reference characters designate the same or similar elements, which figures are incorporated into and constitute a part of the specification, wherein.

DETAILED DESCRIPTION OF THE INVENTION

It is to be understood that the figures and descriptions of the present invention have been simplified to illustrate elements that are relevant for a clear understanding of the present invention, while eliminating, for purposes of clarity, other elements that may be well known. Those of ordinary skill in the art will recognize that other elements are desirable and/or required in order to implement the present invention. However, because such elements are well known in the art, and because they do not facilitate a better understanding of the present invention, a discussion of such elements is not provided herein. The detailed description of the present invention and the preferred embodiment(s) thereof is set forth in detail below with reference to the attached drawings.

Embodiment 1

Referring to FIGS. 1 through 4, a preferred Embodiment 1 of the present invention is described below. The overall circuitry structure of a display panel of Embodiment 1 is first described.

Figure 1:
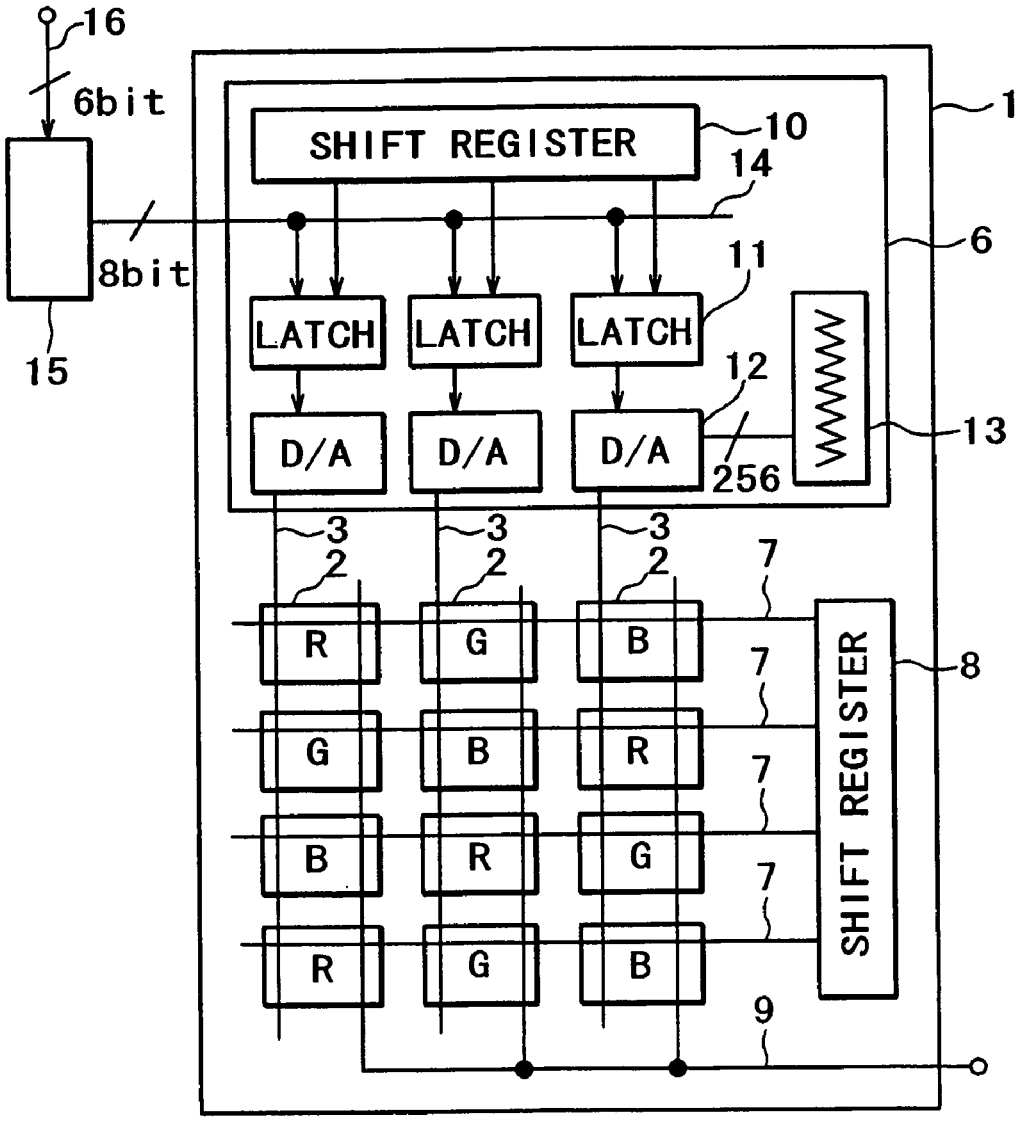
FIG. 1 is a diagram representing a schematic circuitry structure of an organic EL display panel according to a preferred Embodiment 1 of the present invention.

FIG. 1 is a diagram representing a schematic circuitry structure of an organic EL display panel of Embodiment 1.

Pixels 2, each having an organic EL element of one of the three colors R, G, and B as the phosphor of the pixel, are arranged in a matrix in the display area of the panel. The pixels 2 are interconnected by gate lines 7, signal lines 3, and power supply lines 9. The gate lines 7 running in the row direction are connected to a shift register 8 and the signal lines 3 running in the column direction are connected to an analog signal drive circuit 6. The pixels 2, shift register 8, and analog signal drive circuit 6 are fabricated on a glass substrate 1, using polycrystalline Si TFTs. A digital signal input terminal 16 is the input to a digital pixel data conversion circuit 15 and the output of the digital pixel data conversion circuit 15 is input to the analog signal drive circuit 6. Digital pixel data entered in the analog signal drive circuit 6 is carried by a digital signal line 14 and latched by latch circuits 11, according to a scan controlled by the shift register 10. The outputs of the latch circuits 11 are input to D-A converters 12 and the outputs of the D-A converters 12 are delivered to the signal lines 3. To the D-A converters 12, a resistor 13 generating voltages corresponding to tone values supplies any of the voltages of 256 analog tone values.

Next, the operation of the display device of Embodiment 1 is described below.

6-bit digital data for individual R, G, and B pixels input to the digital signal input terminal 16 are converted into 8-bit digital data for individual R, G, and B pixels by the digital pixel data conversion circuit 15. The 8-bit R, G, and B digital pixel data are input to the analog signal drive circuit 6 built on the glass substrate 1. The 8-bit R, G, and B digital pixel data entered in the analog signal drive circuit 6 is carried by the digital signal line 14 and each 8-bit pixel data is latched by one of the latch circuits 11, according to a scan controlled by the shift register 10. The shift register 10 controls scan timing so that the R, G, and B pixel data on the digital signal line 14 will be scanned in a cycle during each horizontal scan period. Upon the completion of writing the R, G, and B pixel data into the latch circuits 11, the written 8-bit R, G, and B digital pixel data are all input to the corresponding D-A converters 12 during a horizontal retrace period that follows each horizontal scan. The D-A converters 12 have the following function: they select one of the voltages of 256 analog tone values output from the resistor 13 generating voltages corresponding to tone values in accordance with the 8-bit R, G, or B digital pixel data input to them and output the selected analog tone value voltage over the signal line 3. At this time, the shift register 8 causes a scan to take place selectively on one of the gate lines 7 at the given timing, the gate line across the pixels to which the tone values voltages output by the D-A converters are to be applied. To the pixels 2 in the scanned row, the voltages of analog tone values carried over the signal lines 3 in the columns are applied.

Next, a pixel 2 having an organic EL element is described below.

Figure 2:
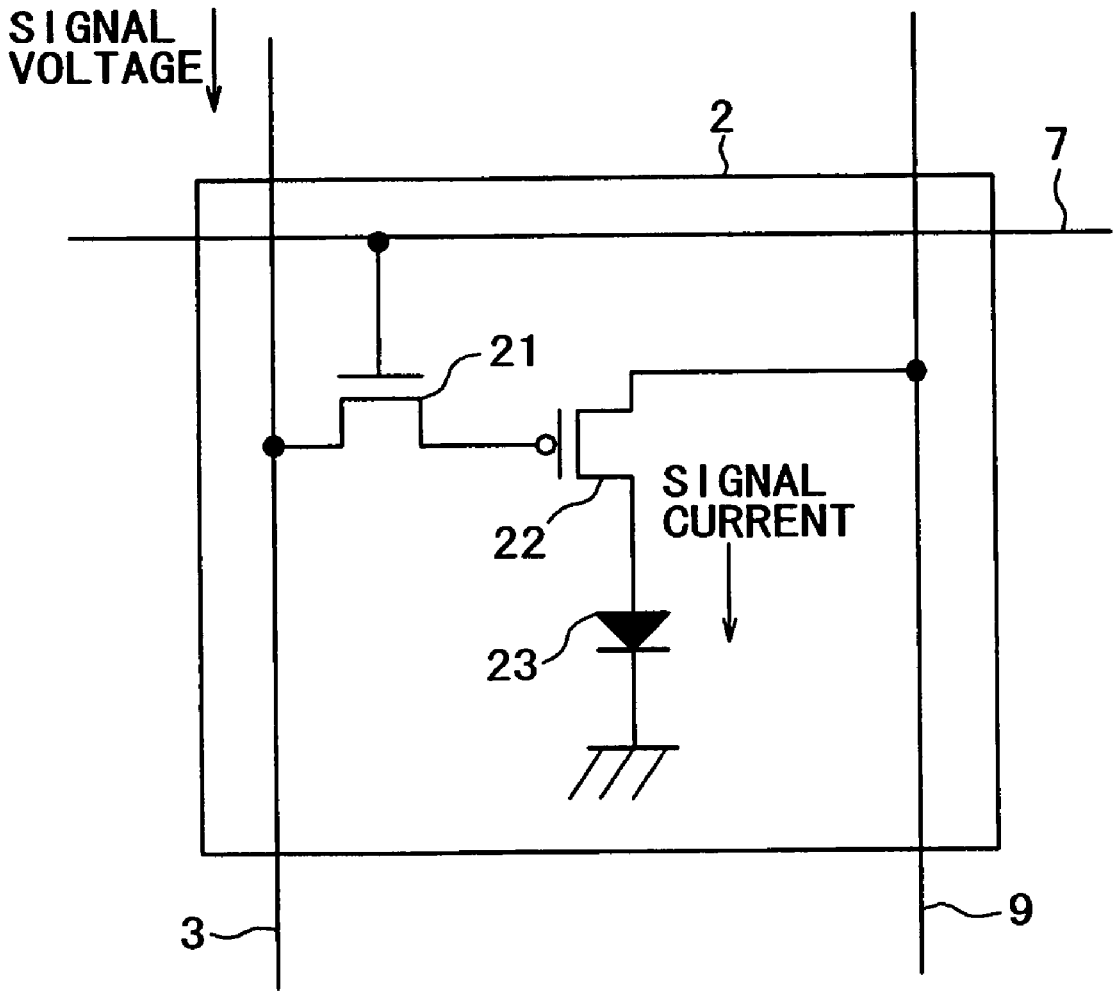
FIG. 2 is a diagram representing the circuit structure of a pixel in the display device circuitry of Embodiment 1.

FIG. 2 represents the circuit structure of a pixel 2. One end of an organic EL element 23 is connected to a common ground voltage and the other end is connected to the drain of an organic EL element drive TFT 22. The gate of the organic EL element drive TFT 22 is connected to one end of a pixel input switch 21. The other end of the pixel input switch 21 is connected to one of the above-mentioned signal lines 3. The gate of the pixel input switch 21 is connected to one gate line 7. The source of the organic EL element drive TFT 22 is connected to one of the power supply lines 9, which connects the pixels to a common power supply as shown in FIG. 1. The organic EL element drive TFT 22 and the pixel input switch 21 are preferably constructed as polycrystalline Si TFTs.

The operation of the pixel 2 is described below. When the gate line 7 to which the pixel 2 is connected is selected under the control of the shift register 8, the pixel input switch 21 of the pixel 2 turns on and the signal voltage, that is, the analog tone value voltage carried by the signal line 3, is input to the gate of the organic EL element drive TFT 22. Even after the pixel input switch 21 turns off, the analog tone value voltage is retained by the gate capacitance of the organic EL element drive TFT 22 until the pixel input switch 21 of the pixel 2 turns on again when the gate line to which the pixel connects is selected for a further frame scan under the control of the shift register 8. The organic EL element drive TFT 22 allows an analog signal current produced by the analog tone value voltage applied to its gate to flow across the organic EL element 23. The organic EL element 23 emits light with chromaticity depending on the signal current flowing across it. In this way, light emission in a tone in accordance with the signal voltage, that is, the above-mentioned analog tone value voltage can be performed.

Regarding the fundamental structure of the analog signal drive circuit 6 and scanning the pixels 2, described above, there is no significant difference from the fundamental structure of the drive circuit of the liquid crystal display device cited as the prior art example or from the scanning operation of the liquid crystal pixels. However, the digital pixel data conversion circuit 15 is a noticeable feature of the present invention in preferred Embodiment 1 and this circuit and its function are explained below in further detail.

In preferred Embodiment 1, the R, G, and B digital pixel data input to the digital signal input terminal 16 each have 6-bit data quantity. However, after passing through the digital pixel data conversion circuit 15, the R, G, and B digital pixel data each consist of 8 bits which are input to the analog signal drive circuit 6. Thus, the analog signal drive circuit 6 is able to output a range of voltages of 256 analog tone values in accordance with 8-bit R, G, and B digital pixel data. This is because the digital pixel data conversion circuit 15 functions to compensate for differences in light emission characteristics among the R, B, and G organic EL elements 23 when they emit light in response to the signal voltage input to their organic EL element drive TFTs 22.

Figures 3, 4:
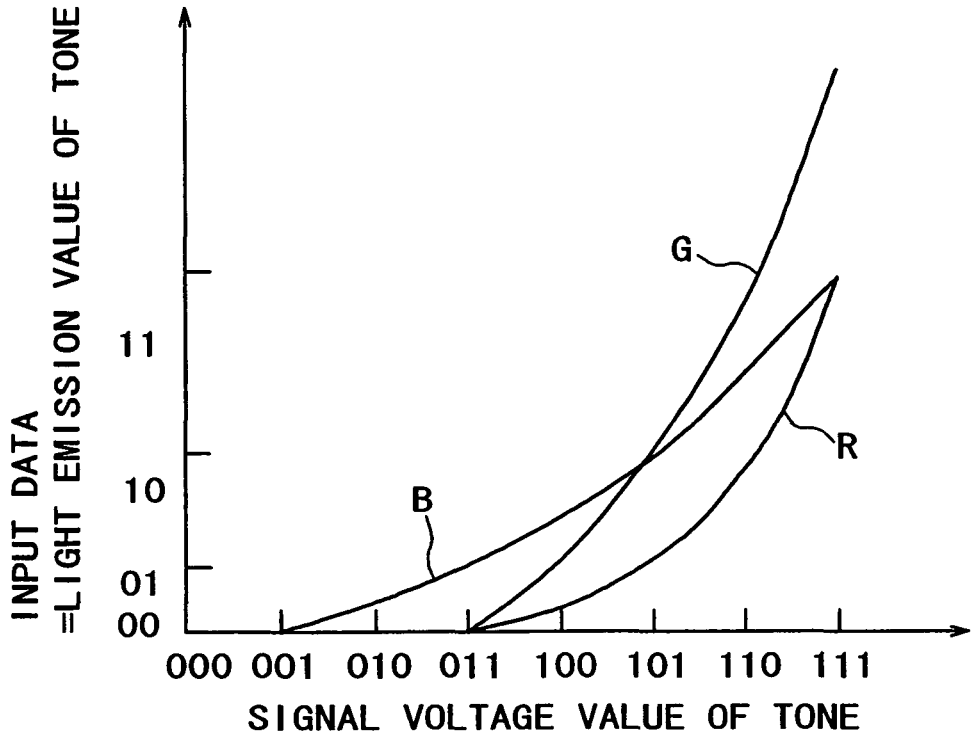
FIG. 3 shows a graph explaining the light emission characteristics of organic EL elements used in the display device of Embodiment 1.
FIG. 4 shows a digital pixel data conversion table which is used in Embodiment 1.

FIG. 3 shows a graph for explaining the light emission characteristics of the R, B, and G organic EL elements 23 in response to the input signal voltage. In this graph, 3-bit signal voltage values of tone and 2-bit light emission values of tone are plotted and the light emission characteristics are represented by curves derived from the values. As shown, each of the R, G, and B organic EL elements 23 starts to emit light at different signal voltage values and their curves rise with different gradients in response to the signal voltage values. For example, element B starts to emit light at a signal voltage value of tone of 001 and elements G and R start to emit light at a signal voltage value of tone of 011. The gradient of the luminance rise characteristic curve of element G is the steepest; that of element R is the next steepest and that of element B is rather gentle. In this condition, if the same signal voltage is applied to the R, G, and B pixels as a signal voltage value of tone to make display in a non-color gray scale from black to white, only the element B emits light at low luminance (001), resulting in a pure green color display, and the element G intensively emits light at high luminance (111), resulting in a green white color display.

In preferred Embodiment 1, to compensate for such difference of the light emission characteristics, the digital pixel data conversion circuit 15 converts digital pixel data as illustrated in the conversion table shown in FIG. 4. For example, when digital pixel data of 00 for B, 00 for G, and 00 for R are input to the digital pixel data conversion circuit 15, the circuit converts them and outputs digital pixel data of 001 for B, 011 for G, and 011 for R. When digital pixel data of 11 for B, 11 for G, and 11 for R are input, the circuit converts them and outputs digital pixel data of 111 for B, 110 for G, and 111 for R. Independent of digital pixel data values input to the digital pixel data conversion circuit 15, the circuitry of preferred Embodiment 1 enables display in a consistent color temperature scale and desired colors.

In preferred Embodiment 1, the display color temperature scale can be altered in real time by rewriting the data conversion table that is referenced by the digital pixel data conversion circuit 15 or referring to a different data conversion table. This function can be used, for example, when the display is used adaptively to the light condition in its environment or the color temperature scale is adjusted for deterioration of the organic EL elements 23. Alternatively, color temperature setting can be altered optionally for the display area for text and the display area for natural images on the display screen. If this setting is performed, in general, it is preferable to set the color temperature of the display area for text higher than that of the display area for natural images to improve the easiness to read text on the display screen.

While the analog signal drive circuit 6 is constructed together with the pixels, using polycrystalline Si-TFTs in preferred Embodiment 1, the present invention is not limited to such construction. Alternatively, the peripheral circuits to the pixels, such as the analog signal drive circuit 6, may be embodied in monocrystalline LSIs and mounted on the substrate. Even in the monocrystalline LSI embodiment of the analog signal drive circuit 6, it is not necessary to construct separate analog signal drive circuits 6 for R, G, and B pixels and this is obviously beneficial in view of the cost of packaging.

Although the light emission characteristics of the R, G, and B organic EL elements 23, explained in association with this preferred Embodiment 1, change if the material of the organic EL elements changes, it should be appreciated that application of the present invention is not restricted to specific material of the organic EL elements. While digital pixel data to be input to the digital pixel data conversion circuit 15 consists of 6 bits and the data to be output from it consists of 8 bits in this preferred embodiment, the present invention is applicable regardless of the number of bits of the digital pixel data.

Embodiment 2

Figure 5:
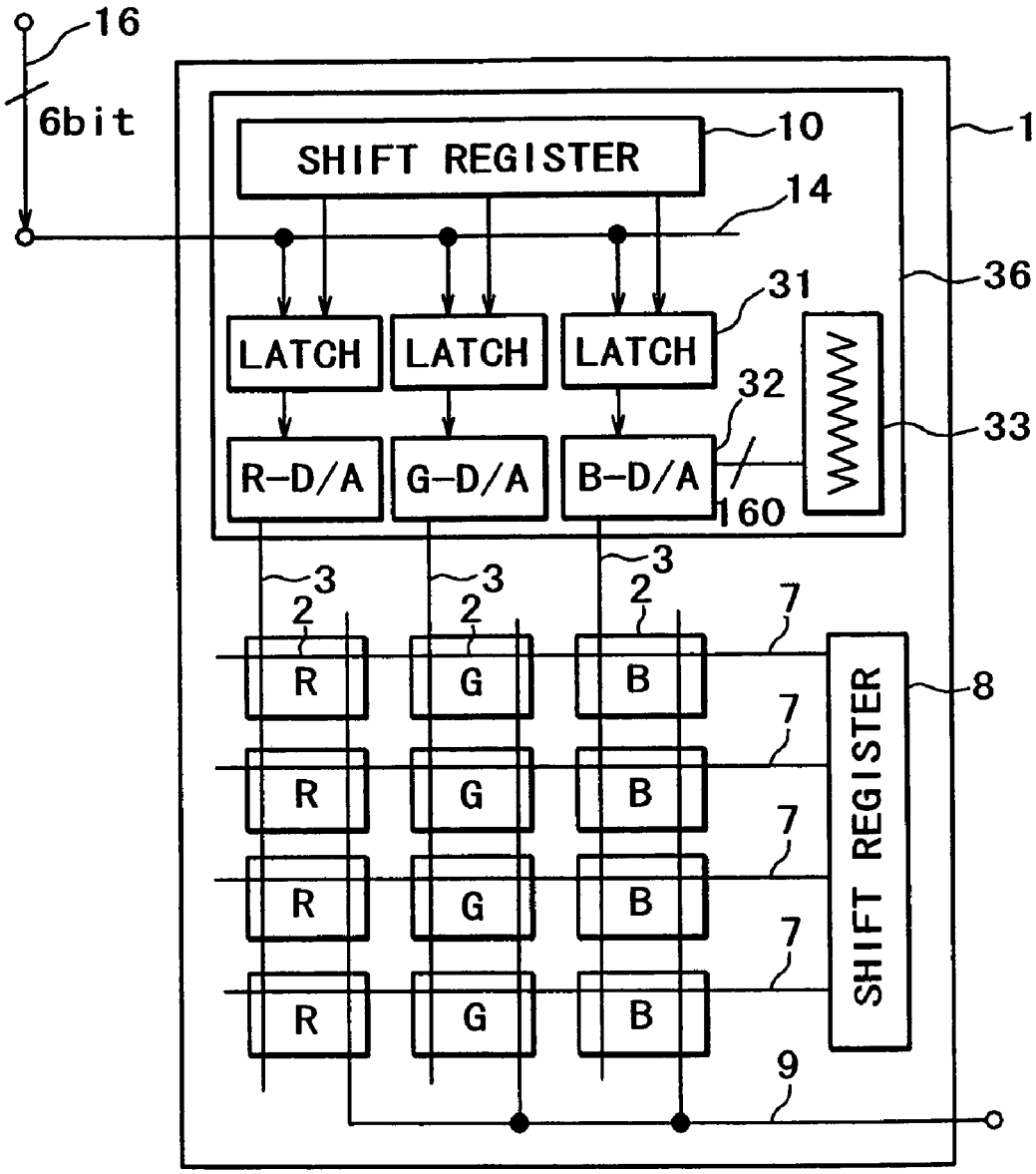
FIG. 5 is a diagram representing a schematic circuitry structure of an organic EL display panel according to a preferred Embodiment 2 of the present invention.

Referring to FIG. 5, a preferred Embodiment 2 of the present invention is described below.

FIG. 5 is a diagram representing a schematic circuitry structure of an organic EL display panel of preferred Embodiment 2.

The overall configuration and operation of the display device circuitry of Embodiment 2 is essentially the same as those of the corresponding circuitry of preferred Embodiment 1, except that the circuitry of Embodiment 2 does not include the digital pixel data conversion circuit 15 and the constitution of the analog signal drive circuit 36 has been altered. Therefore, in the following, the overall configuration and operation of the circuitry of Embodiment 2 will not be described to avoid repetition and description focuses on the difference from the circuitry of Embodiment 1 to explain the features of Embodiment 2.

In Embodiment 2, data from the digital signal input terminal 16 is directly input to the analog signal drive circuit 36. The data entered in the analog signal drive circuit 36 is carried by a digital signal line 14 and latched by latch circuits 31, according to a scan controlled by a shift register 10. The outputs of the latch circuits 31 are input to D-A converters 32 and the outputs of the D-A converters 32 are delivered to the signal lines 3. To the D-A converters 32, a resistor 33 generating voltages corresponding to tone values supplies any of the voltages of 160 analog tone values.

Next, the operation of the analog signal drive circuit 36 is described.

6-bit digital data for individual R, G, and B pixels input to the digital signal input terminal 16 are input to the analog signal drive circuit 36 built on the glass substrate 1. The 6-bit R, G, and B digital pixel data entered in the analog signal drive circuit 36 are carried by the digital signal line 14 and each 6-bit pixel of data is latched by one of the latch circuits 31, according to a scan controlled by the shift register 10. The shift register 10 controls scan timing so that the R, G, and B pixel data on the digital signal line 14 will be scanned in a cycle during each horizontal scan period. Upon the completion of writing the R, G, and B pixel data into the latch circuits 31, the written 6-bit R, G, and B digital pixel data are all input to the corresponding D-A converters 32 during a horizontal retrace period that follows each horizontal scan. The D-A converters 32 are designed such that the D-A converter for R (R-D/A), D-A converter for G (G-D/A), and D-A converter for B (B-D/A) have different D-A conversion characteristics. The D-A converters 32 corresponding to R, G, and B have the following function: they select one of the voltages of 160 analog tone values output from the resistor 33 generating voltages corresponding to tone values in accordance with the 6-bit R, G, or B digital pixel data input to them and output the selected analog tone value voltage over the signal lines 3.

The D-A converters 32 in preferred Embodiment 2 also fill the role of the digital pixel data conversion circuit 15 in Embodiment 1. That is, the D-A converters output different voltage values of analog tones corresponding to R, G, and B from the same 6-bit digital pixel of data over the signal lines 3. Thereby, the circuitry of preferred Embodiment 2 enables display in a consistent color temperature scale and desired colors, independent of the input digital pixel data values, as is the case for Embodiment 1.

In Embodiment 2, R, G, and B pixels in the pixel matrix preferably are arrayed into R, G, and B stripes in the column direction. To the R, G, and B pixels in the stripes, the corresponding D-A converters 32 for the R, G, and B colors are arranged to supply data over the signal lines 3. However, it should be appreciated that the present invention is not restricted to such arrangement of R, G, and B pixels. In some embodiments, for example, a switch for line reconnection may be installed between the D-A converters 32 and the signal lines 3 to accommodate alternative arrangements of R, G, and B pixels.

In Embodiment 2, the shift register 10, latch circuits 31, and other main components of the analog signal drive circuit 36 are common for R, G, and B pixels. Furthermore, the resistor 13 generating voltages corresponding to tone values outputs any of the voltages of 160 analog tone values. According to the manner completely different from the circuitry concept of providing separate drive circuits for R, G, and B pixels as described above with regard to the prior-art display device, the analog signal drive circuit of preferred Embodiment 2 has a reduced area.

In the alternative to preferred Embodiment 2, it may be possible to build peripheral circuits to the pixels such as the analog signal drive circuit 36 in monocrystalline LSIs and mount them on the substrate.

Although voltage values are set to correspond to 160 analog tones in this embodiment, the voltage values should be determined by the number of common analog tones that can be used by R, G, and B pixels. It will be appreciated that an optimum number of tones preferably should be designed beforehand, according to the type of the organic EL elements used to emit R, G, and B light or selectable display colors.

Embodiment 3

Figure 6:
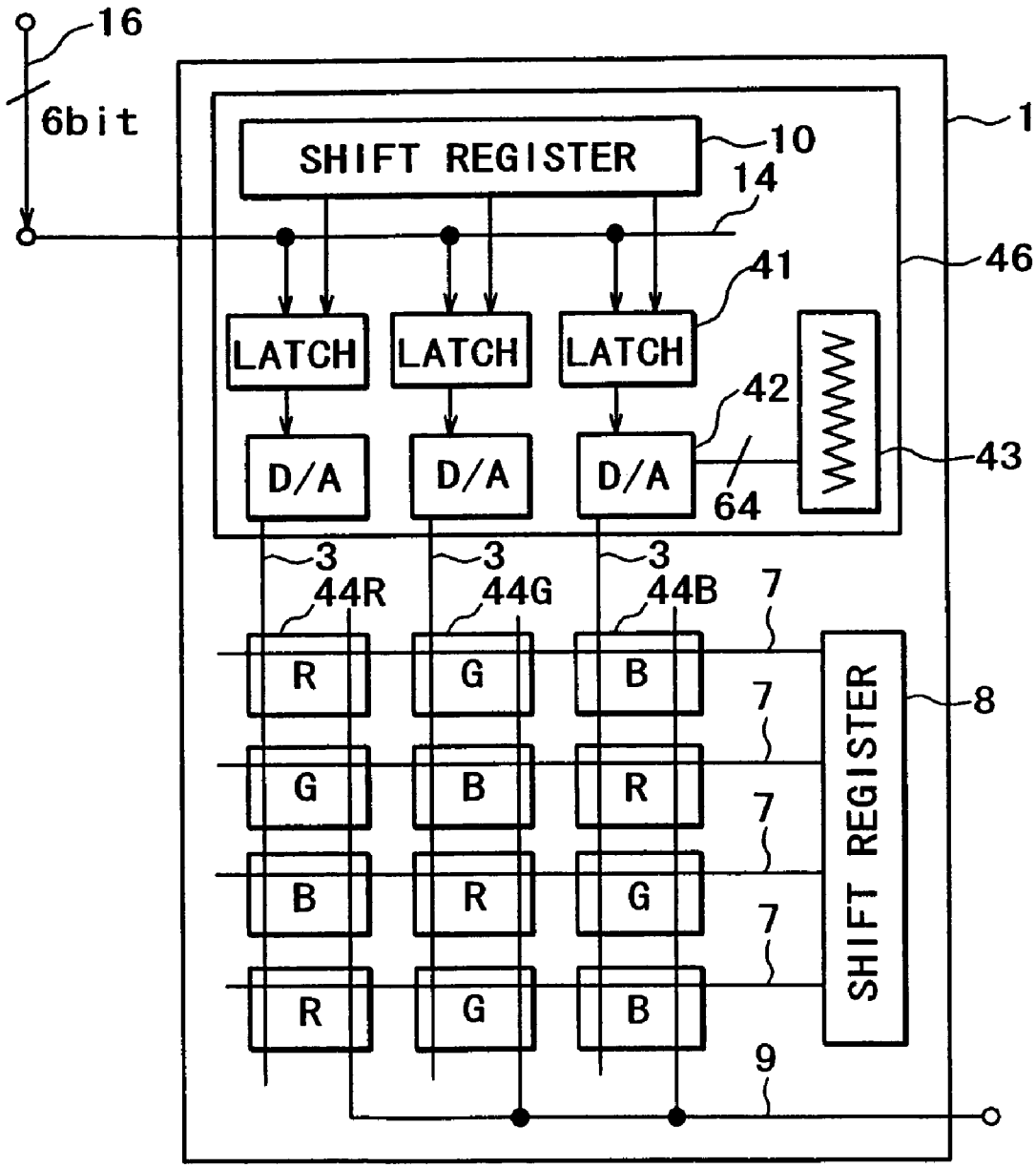
FIG. 6 is a diagram representing a schematic circuitry structure of an organic EL display panel according to a preferred Embodiment 3 of the present invention.
Figure 7:
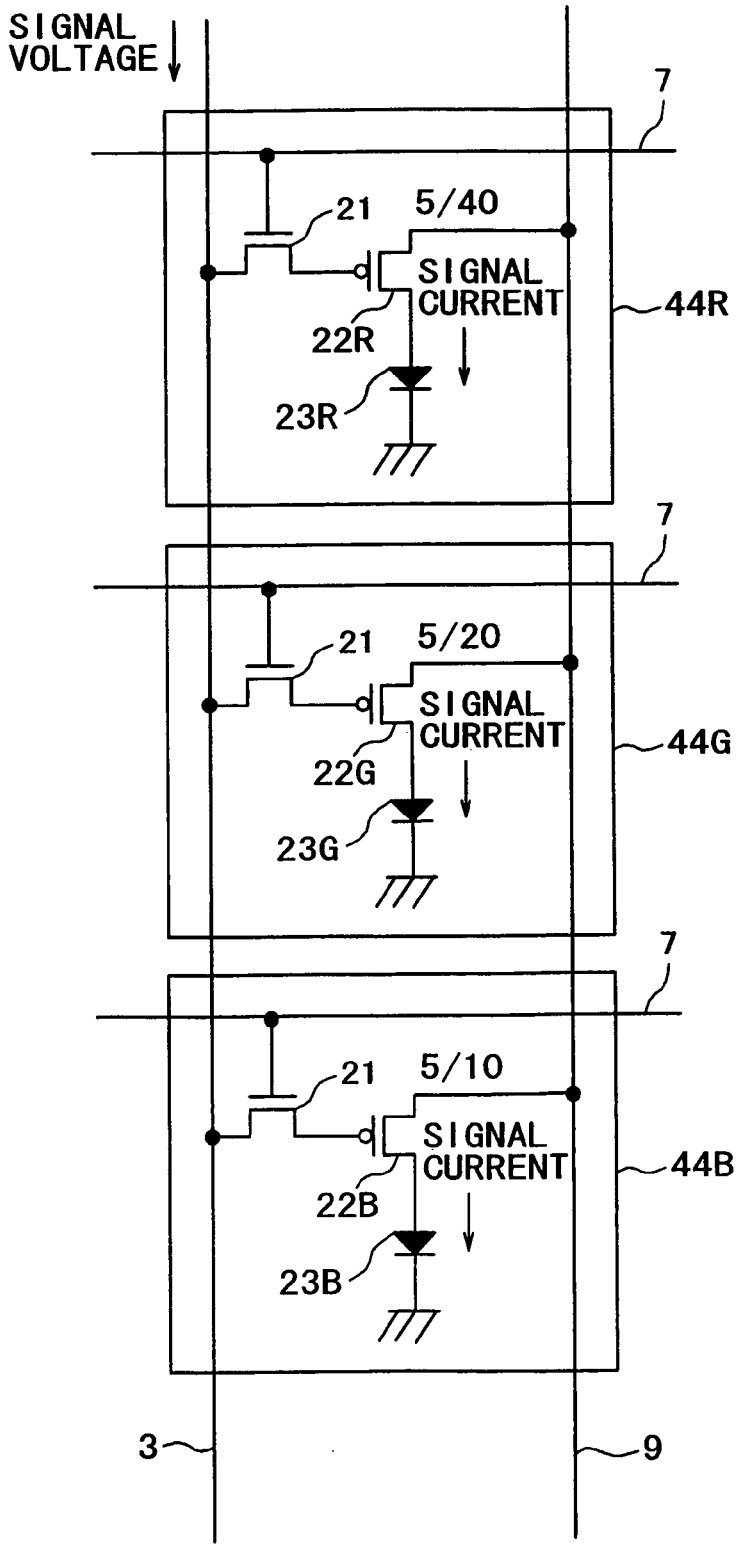
FIG. 7 is a diagram representing the circuit structures of pixels in the display device circuitry of Embodiment 3.

Referring to FIGS. 6 and 7, a preferred Embodiment 3 of the present invention is described below.

FIG. 6 is a diagram representing the schematic circuitry structure of an organic EL display panel of Embodiment 3.

The overall configuration and operation of the display device circuitry of Embodiment 3 is essentially the same as that of preferred Embodiment 1, except that the circuitry of Embodiment 3 does not include the digital pixel data conversion circuit 15 and the construction of the analog signal drive circuit 46 is different. Therefore, in the following, the overall configuration and operation of the circuitry of Embodiment 3 will not be described to avoid repetition and the description focuses on the difference from the circuitry of Embodiment 1 to explain the features of preferred Embodiment 3.

In Embodiment 3, data from the digital signal input terminal 16 is directly input to the analog signal drive circuit 46. The data entered in the analog signal drive circuit 46 is carried by a digital signal line 14 and latched by latch circuits 41, according to a scan controlled by a shift register 10. The outputs of the latch circuits 41 are input to D-A converters 42 and the outputs of the D-A converters 42 are delivered to the signal lines 3. To the D-A converters 42, a resistor 43 generating voltages corresponding to tone values supplies any of the voltages of 64 analog tone values which are represented in 6 bits.

Next, the operation of the analog signal drive circuit 46 is described below.

6-bit digital data for individual R, G, and B pixels input to the digital signal input terminal 16 are input to the analog signal drive circuit 46 built on the glass substrate 1. The 6-bit R, G, and B digital pixel data entered in the analog signal drive circuit 46 are carried by the digital signal line 14 and each 6-bit pixel data is latched by one of the latch circuits 41, according to a scan controlled by the shift register 10. The shift register 10 controls scan timing so that the R, G, and B pixel data on the digital signal line will be scanned in a cycle during each horizontal scan period. Upon the completion of writing the R, G, and B pixel data into the latch circuits 41, the written 6-bit R, G, and B digital pixel data are all input to the corresponding D-A converters 42 during a horizontal retrace period that follows each horizontal scan. The D-A converters 42 have the following function: they select one of the voltages of 64 analog tone values output from the resistor 43, generating voltages corresponding to tone values in accordance with the 6-bit R, G, or B digital pixel data input to them and output the selected analog tone value voltage over the signal lines 3.

The analog signal drive circuit 46 included in the circuitry of preferred Embodiment 3 has the function of supplying an analog tone value voltage corresponding to a 6-bit digital value of pixel data independent of R, G, and B colors to all pixels 44.

Next, the circuit structures of pixels 44 in the circuitry of preferred Embodiment 3 are described in reference to FIG. 7.

FIG. 7 is a diagram representing the circuit structures of pixels 44 in the circuitry of preferred Embodiment 3, where the circuit structures of pixels 44R, 44G, and 44B corresponding to three R, G, and B colors are shown. One end of each of the organic EL elements 23R, 23G, and 23B is connected to a common ground voltage and the other end is connected to the drain of organic EL element drive TFTs 22R, 22G, and 22B, respectively. Each of the gates of the organic EL element drive TFTs 22R, 22G, and 22B is connected to one end of pixel input switches 21, respectively, the other end of the pixel input switches 21 are connected to one of the above-mentioned signal lines 3. The gates of the pixel input switches 21 are connected to gate lines 7, respectively. The sources of the organic EL element drive TFTs 22R, 22G, and 22B are connected to one of the power supply lines 9 which connect the pixels to a common power supply as shown in FIG. 1. The organic EL element drive TFTs 22R, 22G, and 22B and pixel input switches 21 are preferably constructed as polycrystalline Si-TFTs.

The operation of the pixels 44R, 44G, and 44B is described below. When one of the gate lines 7 is selected under the control of the shift register 8, the pixel input switch 21 of the pixel 44R, 44G, or 44B which connects to the gate line turns on and the signal voltage, that is, the analog tone value voltage carried by the signal line 3, is input to the gate of the organic EL element drive TFT 22R, 22G, or 22B. Even after the pixel input switch 21 turns off, the analog tone value voltage remains retained by the gate capacitance of the organic EL element drive TFT 22R, 22G, or 22B until the pixel input switch 21 of the pixel 44R, 44G, or 44B turns on again, when the gate line to which the pixel connects is selected for a further frame scan under the control of the shift register 8. The organic EL element drive TFT 22R, 22G, or 22B allows a signal current produced by the analog tone value voltage applied to its gate to flow across the organic EL element 23R, 23G, or 23B. The organic EL element 23R, 23G, or 23B emits light with chromaticity depending on the signal current flowing across it. In this way, light emission in a tone in accordance with the signal voltage, that is, the above-mentioned analog tone value voltage, is performed.

In preferred Embodiment 3, the channels of the organic EL element drive TFTs 22R, 22G and 22B have different dimensions as noted in the drawing; that is, gate width (W)/gate length (L), W/L=5/40, 5/20, and 5/10 for R, G, and B, respectively, as shown in FIG. 7. As described above, the duty of the organic EL element drive TFT 22 is to allow the signal current produced by the analog tone value voltage applied to its gate to flow across the organic EL element 23, thereby making the organic EL element 23 emit light. The different channel dimensions cause different signal currents to flow across the organic EL elements 23, even with the application of the same analog tone value voltage. Thereby, the circuitry of preferred Embodiment 3 alleviates the differences in the light emission characteristics of the R, G, and B organic EL elements 23 and enables display in a consistent color temperature scale and desired colors, independent of the input digital pixel data values.

Preferred Embodiment 3 can be applied only by varying the dimensions of the channels of the organic EL element drive TFTs and it is easier to apply than the other preferred embodiments. However, in Embodiment 3, the rate of the signal current to flow across the organic EL elements 23 is simply adjusted so that R, G, and B pixels emit light with equal intensity. Accordingly, Embodiment 3 is unable to compensate for offsets by the R, G, and B organic EL elements and subtle differences exist in the characteristic curves of light emission by these elements. Thus, it is preferable to combine preferred Embodiment 3 with other means such as preferred Embodiments 1 and 2.

While the dimensions of the channels of the organic EL element drive TFTs 22R, 22G, and 22B are set at W/L (gate width/gate length)=5/40 for R, 5/20 for G, and 5/10 for B in Embodiment 3, it will be appreciated that these dimensions preferably should be changed if the material of the organic EL elements changes. It should also be appreciated that the application of the present invention is not restricted to specific material of the organic EL elements. The dimensions of the above channels should be set at optimum values, according to the material and the specifications of display colors.

Embodiment 4

Figure 8:
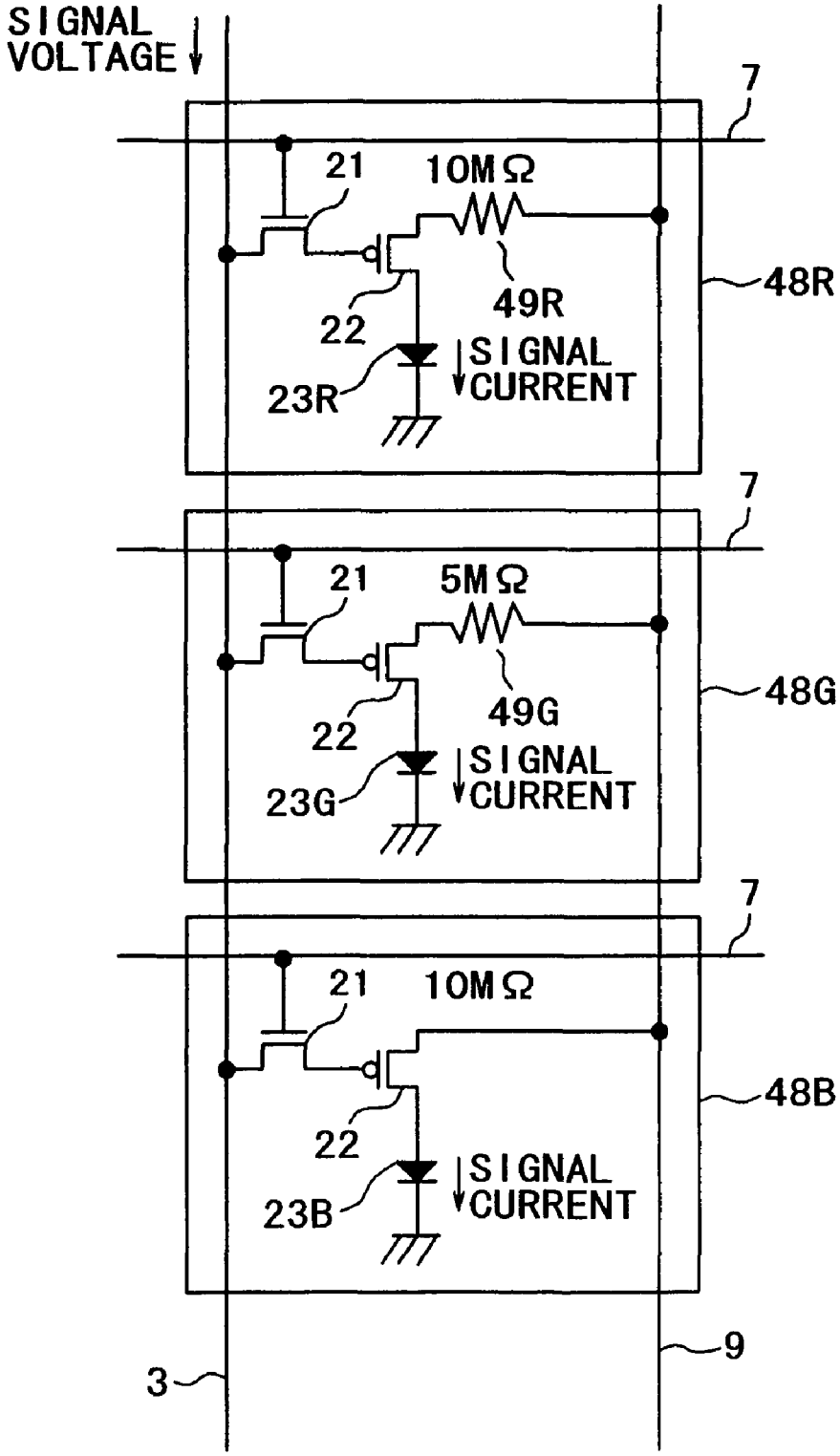
FIG. 8 is a diagram representing the circuit structures of pixels in the display device circuitry of a preferred Embodiment 4 of the present invention.

Referring to FIG. 8, a preferred Embodiment 4 of the present invention is described below.

The overall configuration and operation of the display device circuitry of preferred Embodiment 4 is essentially the same as that of preferred Embodiment 3, except that the circuit structures of the pixels 48 is different. Therefore, in the following, the overall configuration and operation of the circuitry of Embodiment 4 will not be described to avoid repetition and the description focuses on the difference from the circuitry of Embodiment 3 to explain the features of preferred Embodiment 4.

The circuit structures of pixels 48 in the display device circuitry of preferred Embodiment 4 of the present invention is described below in reference to FIG. 8.

FIG. 8 is a diagram representing the circuit structures of pixels 48 in the circuitry of preferred Embodiment 4, where the circuit structures of pixels 48R, 48G, and 48B corresponding to three R, G, and B colors are shown. One end of each of the organic EL elements 23R, 23G, and 23B is connected to a common ground voltage and the other end is connected to the drains of organic EL element drive TFTs 22, respectively. The gates of the organic EL element drive TFTs 22 are connected to a first end of each pixel input switch 21, respectively. The other end of each of the pixel input switch 21 is connected to one of the above-mentioned signal lines 3. The gates of the pixel input switches 21 are connected to gate lines 7, respectively. The sources of the organic EL element drive TFTs 22 are connected to one of the power supply lines 9. Between the source of the drive TFT and the power supply line connection, source resistors 49R and 49G are inserted for the pixels 48R and 48G corresponding to R and G, respectively. The power line 9 connects the pixels to a common power supply as shown in FIG. 1. The organic EL element drive TFTs 22 and pixel input switch 21 preferably are constructed as polycrystalline Si-TFTs and the source resistors 49R and 49G are made of a polycrystalline Si thin-film layer that is the same structure as the above-mentioned channel layer of the TFT.

The operation of the pixels 48R, 48G, and 48B is described below. When one of the gate lines 7 is selected under the control of the shift register 8, the pixel input switch 21 of the pixel 48R, 48G, or 48B, which connects to the gate line, turns on and the signal voltage, that is, the analog tone value voltage carried by the signal line 3, is input to the gate of the organic EL element drive TFT 22. Even after the pixel input switch 21 turns off, the analog tone value voltage remains retained by the gate capacitance of the organic EL element drive TFT 22 until the pixel input switch 21 of the pixel 48R, 48G, or 48B turns on again, when the gate line to which the pixel connects is selected for a further frame scan under the control of the shift register 8. The organic EL element drive TFT 22 allows a signal current produced by the analog tone value voltage applied to its gate to flow across the organic EL element 23R, 23G, or 23B. The organic EL element 23R, 23G, or 23B emits light with chromaticity depending on the signal current flowing across it. In this way, light emission in a tone in accordance with the signal voltage, that is, the above-mentioned analog tone value voltage, is performed.

In preferred Embodiment 4, the source resistors 49R and 49G are inserted and different resistance values are given for R, G, and B. The pixel 48B does not have a source resistor, which should be regarded as having source resistance 0MΩ. As described above, the duty of the organic EL element drive TFT 22 is to allow the signal current produced by the analog tone value voltage applied to its gate to flow across the organic EL element 23, thereby making the organic EL element 23 emit light. The different source resistance values cause different signal currents to flow across the organic EL elements 23, even with the application of the same analog tone value voltage. Thereby, the circuitry of preferred Embodiment 4 alleviates the differences in the light emission characteristics of the R, G, and B organic EL elements 23 and enables display in a consistent color temperature scale and desired colors, independent of the input digital pixel data values.

Preferred Embodiment 4 can be applied only by modifying the pixel circuits and it is easier to apply than other preferred embodiments. However, because fixed resistance is simply adjusted in preferred Embodiment 4, Embodiment 4 is unable to compensate for offsets by the R, G, and B organic EL elements and subtle differences in the characteristic curves of light emission by these elements. It is preferable to combine preferred Embodiment 4 with other means such as preferred Embodiments 1 and 2, as is the case for preferred Embodiment 3.

While the source resistors 49R and 49G give resistance of 10MΩ and 5MΩ respectively in preferred Embodiment 4, it will be appreciated that the resistance values preferably should be changed if the material of the organic EL elements changes. It should be appreciated that the application of the present invention is not restricted to the specific material of the organic EL elements. The above source resistors should be set at optimum values, taking the pixel 48B without such resistor into consideration, according to the material and the specifications of display colors.

Embodiment 5

Referring to FIGS. 9 through 12, a preferred Embodiment 5 of the present invention is described below.

Figure 9:
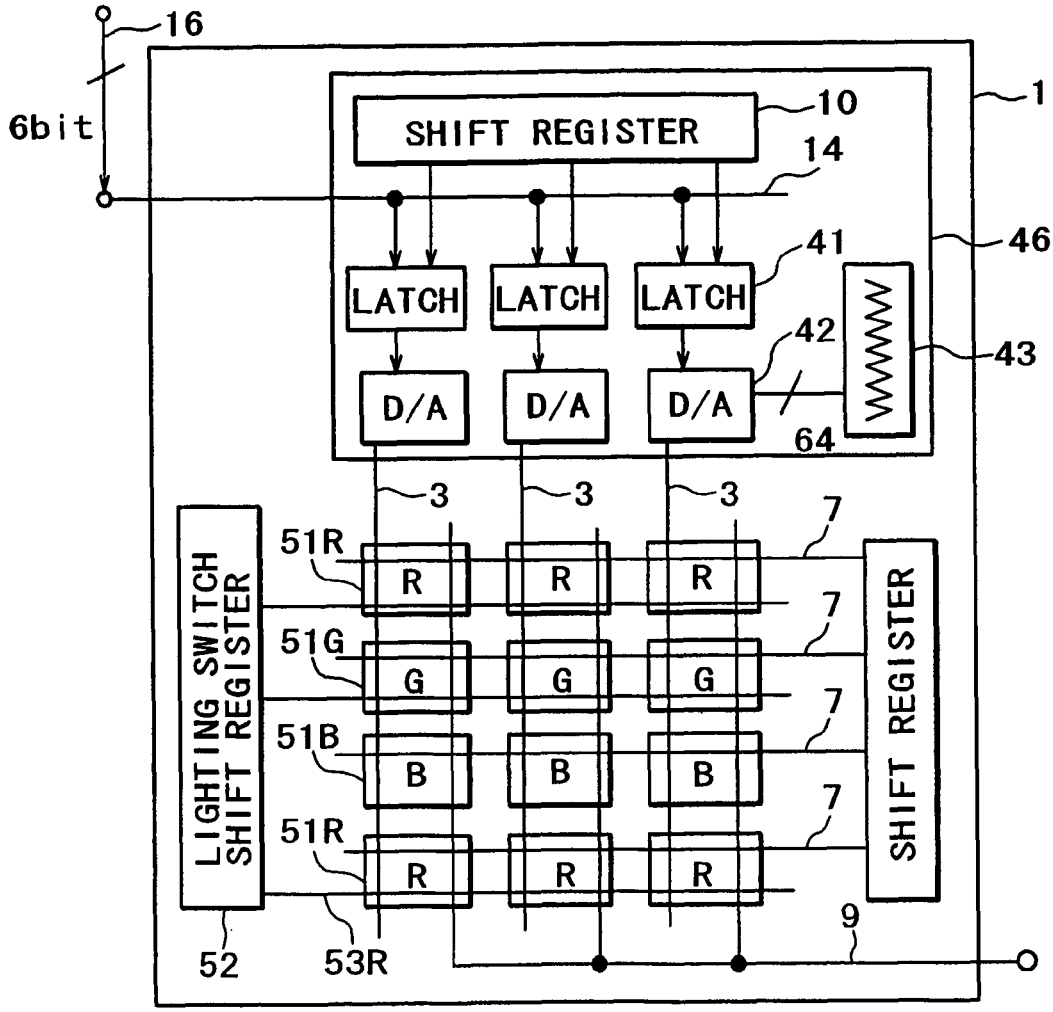
FIG. 9 is a diagram representing a schematic circuitry structure of an organic EL display panel according to a preferred Embodiment 5 of the present invention.

FIG. 9 is a diagram representing a schematic circuitry structure of an organic EL display panel of Embodiment 5.

The overall configuration and operation of the display device circuitry of Embodiment 5 is essentially the same as that of preferred Embodiment 3, except that the circuit structures of pixels 51 are different and a lighting switch shift register is added. Therefore, in the following, the overall configuration and operation of the circuitry of Embodiment 5 will not be described to avoid repetition and the description focuses on the differences from the circuitry of Embodiment 3 to explain the features of preferred Embodiment 5.

In the circuitry of Embodiment 5 of the present invention, as shown in FIG. 9, lighting scan lines 53 from the lighting switch shift register 52 run in parallel with gate lines 7 in the matrix of pixels 51.

The circuit structures of the pixels 51 in the circuitry of Embodiment 5 of the invention are described with reference to FIG. 10.

Figure 10:
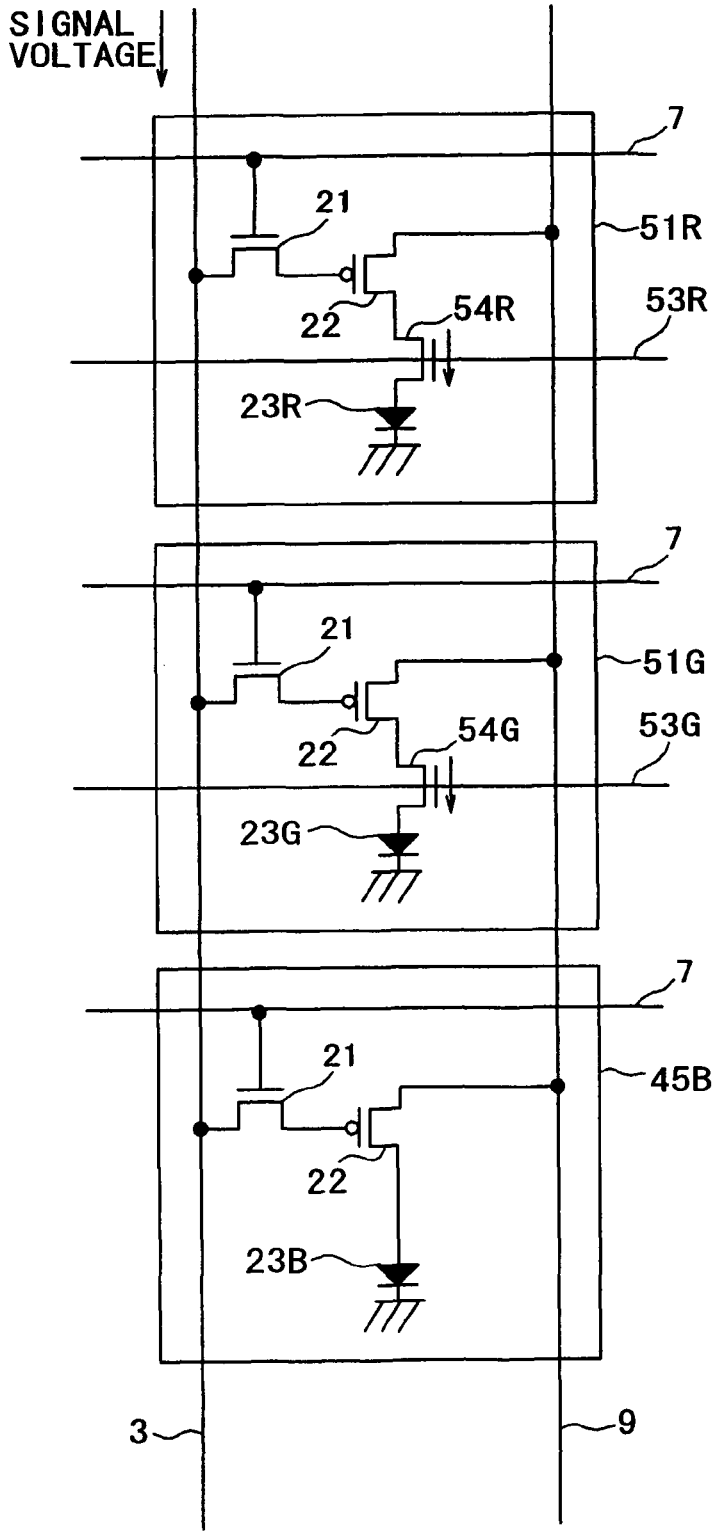
FIG. 10 is a diagram representing the circuit structures of pixels in the display device circuitry of Embodiment 5.

FIG. 10 is a diagram representing the circuit structures of the pixels 51 in the circuitry of preferred Embodiment 5, where the circuit structures of pixels 51R, 51G, and 51B corresponding to three R, G, and B colors are shown. One end of each of the organic EL elements 23R, 23G, and 23B is connected to a common ground voltage and the other end thereof is connected to the drain of an organic EL element drive TFT 22, respectively. For the pixel 51R, a lighting switch 54R is inserted between the organic EL element 23R and the organic EL element drive TFT 22. For the pixel 51G, a lighting switch 54G is inserted between the organic EL element 23G and the organic EL element drive TFT 22. Each of the gates of the organic EL element drive TFTs 22R, 22G, and 22B is connected to one end of a pixel input switch 21, respectively. The other end of each of the pixel input switch 21 is connected to one of the above-mentioned signal lines 3. The gates of the pixel input switches 21 are connected to gate lines 7, respectively. The sources of the organic EL element drive TFTs 22R, 22G, and 22B are connected to one of the power supply lines 9, which connect the pixels to a common power supply as shown in FIG. 1. The organic EL element drive TFTs 22R, 22G, and 22B, pixel input switches 21, and lighting switches 54R and 54G preferably are constructed as polycrystalline Si-TFTs.

The operation of the pixels 51R, 51G, and 51B are described below. When one of the gate lines 7 is selected under the control of the shift register 8, the pixel input switch 21 of the pixel 51R, 51G, or 51B, which connects to the gate line, turns on and the signal voltage, that is, the analog tone value voltage carried by the signal line 3, is input to the gate of the organic EL element drive TFT. Even after the pixel input switch 21 turns off, the analog tone value voltage is retained by the gate capacitance of the organic EL element drive TFT until the pixel input switch 21 of the pixel 51R, 51G, or 51B turns on again, when the gate line to which the pixel connects is selected for a further frame scan under the control of the shift register 8. The organic EL element drive TFT 22 allows a signal current produced by the analog tone value voltage applied to its gate to flow across the organic EL element 23R, 23G, or 23B. The organic EL element 23R, 23G, or 23B emits light with chromaticity depending on the signal current flowing across it. In this way, light emission in a tone in accordance with the signal voltage, that is, the above-mentioned analog tone value voltage, is performed.

In preferred Embodiment 5 the lighting switches 54R and 54G are inserted as mentioned above to make the R, G, and B pixels light for different periods. The pixel 51B does not include a lighting switch 54, which should be regarded as being on as long as it carries current. As described above, the duty of the organic EL element drive TFT 22 is to allow the signal current produced by the analog tone value voltage applied to its gate to flow across the organic EL element 23, thereby making the organic EL element 23 emit light. The lighting switches 54 introduced can limit the lighting period of the organic EL elements 23 to the period as long as the switches 54 are on. This feature is described further with reference to FIGS. 11 and 12.

Figure 11:
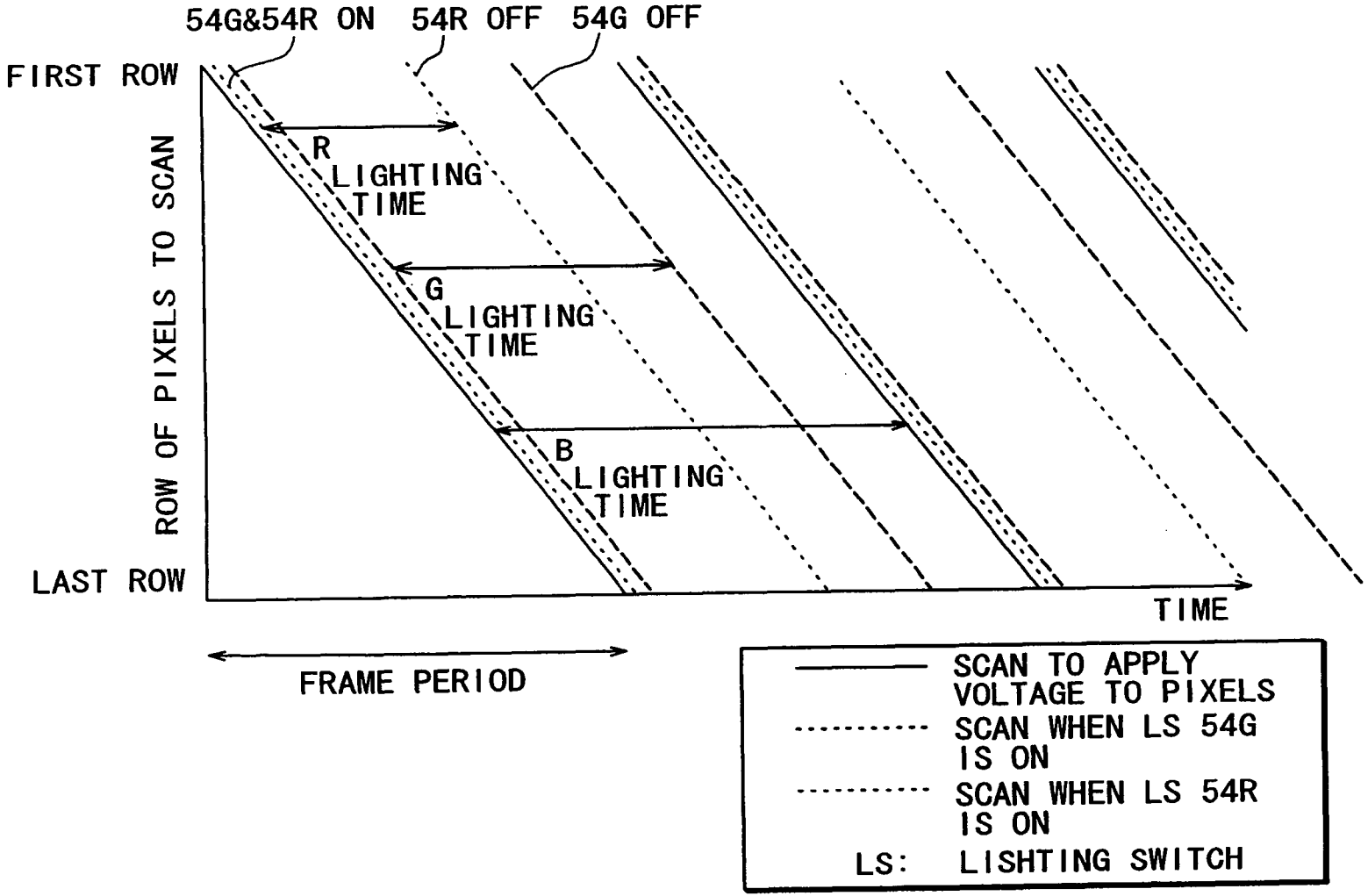
FIG. 11 is a scan timing chart for pixels in the circuitry of Embodiment 5.

FIG. 11 is a chart of the timing of a scan to apply voltage to pixels, which is determined by the pixel input switch 21, and the timing of a scan by lighting switch, which is determined by the lighting switches 54R and 54G. With time along the abscissa, rows of pixels on the ordinate are to be scanned from the first row of pixels at the top to the last row of pixels at the bottom. In FIG. 11, solid lines indicate scanning to apply voltage to pixels during every frame period sequentially from the first row of pixels to the last row of pixels. Two kinds of dotted lines indicate the timing of scans by the lighting switches 54R and 54G. Timing to turn the lighting switches 54R and 54G on and off is specified, respectively, as shown. The following features are apparent from FIG. 11. The on-period of the lighting switch 54R is limited to about a half the frame period and the period during which the R pixel lights is limited accordingly. The on-period of the lighting switch 54G is limited to about three fourths the frame period and the period during which the G pixel lights is limited accordingly. The period during which the B pixel lights is equivalent to the frame period.

Figure 12:
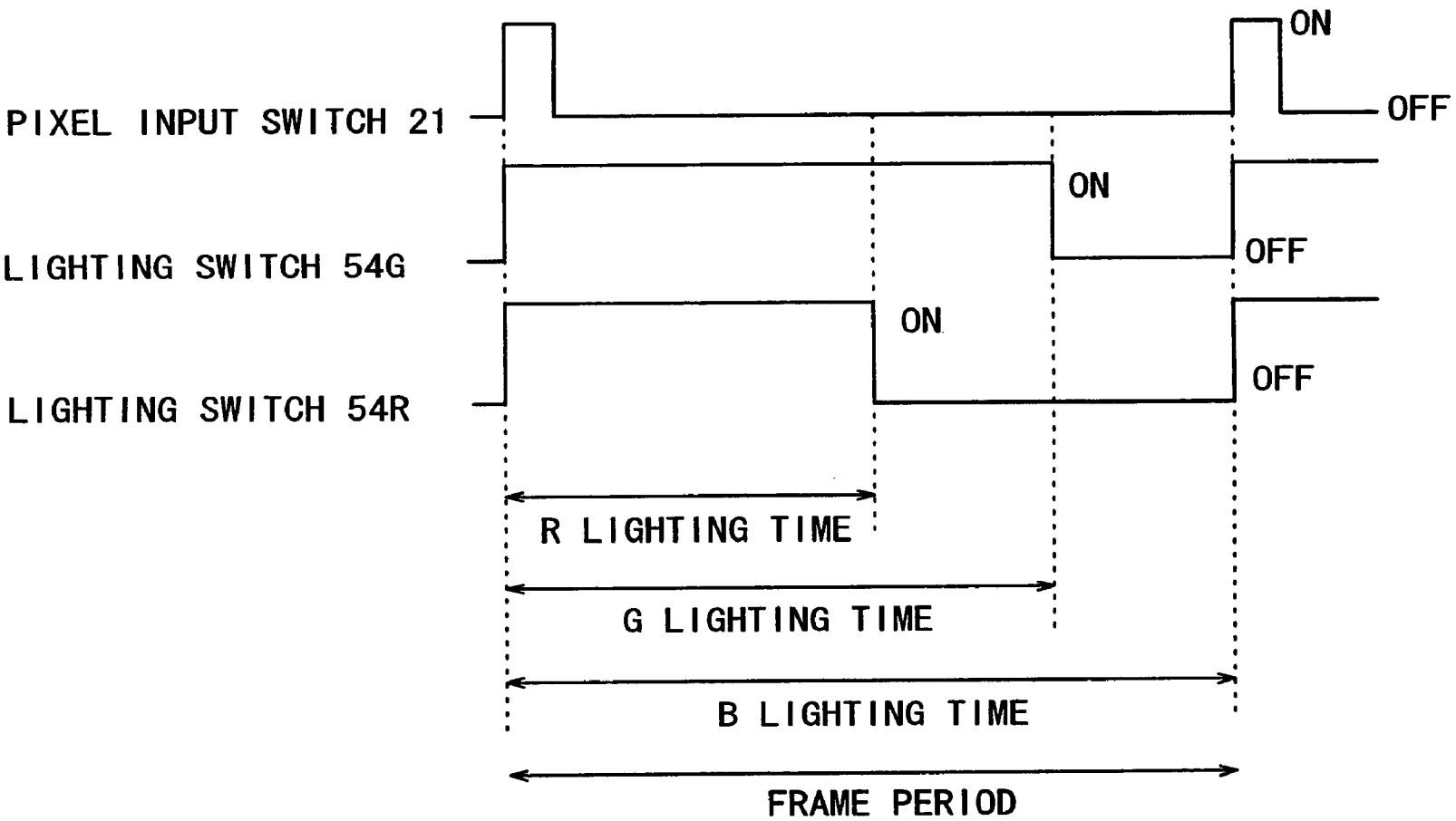
FIG. 12 is a drive timing chart for the lighting switches in the circuitry of preferred Embodiment 5.

FIG. 12 is a chart of the timing to actually drive the lighting switches 54G and 54R and the timing to drive the pixel input switch 21. For simplification, this chart represents switch operation when scanning pixels in the first row; in practical application, however, it is not always necessary to place R, G, and B pixels on the first row, as described below. Even for the switch operation timing for pixels placed on other rows, the switching pulses occur in the same timing as shown, with only the time axis shifting in parallel with the frame period. It should be appreciated that the chart shown in FIG. 12 is simplified for convenience of explanation. As described with respect to FIG. 11, when the pixel input switch 21 is turned on at the beginning of a frame period, the signal voltage, that is, the analog tone value voltage carried by the signal line 3, is input to the gate of the organic EL element drive TFT 22. At this time, the lighting switches 54G and 54R are turned on at the same timing, thereby causing the organic EL elements 23R, 23G, and 23B to light at once (of course, lighting does not occur if the analog tone value voltage input to the pixel is a value to "inhibit lighting"). Then, the lighting switch 54R is turned off when about a half the frame period has elapsed, which causes the organic EL element 23R to go off. Then, the lighting switch 54G is turned off when about three fourths the frame period has elapsed, which causes the organic EL element 23G to go off. Meanwhile, the organic EL element 23B remains lighted during the frame period.

In this way, in the circuitry of preferred Embodiment 5, the organic EL elements 23 can be arranged to light for different periods even with the application of the same analog tone value voltage. Thereby, the circuitry of preferred Embodiment 5 compensates for the difference in the light emission characteristics of the R, G, and B organic EL elements 23 and enables display in a consistent color temperature scale and desired colors, independent of the input digital pixel data values.

The advantage of preferred Embodiment 5 is that a ratio of the on-period of each organic EL element 23 to the frame period can be changed from the external by appropriately setting the on-period of the corresponding lighting switch 54. However, in preferred Embodiment 5, the on-periods of two of the R, G, and B organic EL elements 23 in a set are simply adjusted to an optimum ratio of the on-period to the frame period. Accordingly, Embodiment 5 is unable to compensate for offsets by the R, G, and B organic EL elements and subtle differences in the characteristic curves of light emission by these elements. It is preferable to combine preferred Embodiment 5 with other means such as preferred Embodiments 1 and 2.

The ratios of the on-periods of the pixels R, G, and B to the frame period preferably are respectively set at 1:2, 3:4, and 1:1 in Embodiment 5, it will be appreciated that these ratios should be changed if the material of the organic EL elements changes. It should be appreciated that the application of the present invention is not restricted to specific material of the organic EL elements. The above ratios of the on-periods should be set at optimum ratios, according to the material and the specifications of display colors.

As shown in FIG. 9, R, G, and B pixels preferably are arrayed into R, G, and B stripes in the row direction in this embodiment. This arrangement of the colors has the advantage that the layout of the lighting scan lines 53 can be simplified. However, it will be appreciated that the application of the present invention is not restricted to this arrangement of pixels.

Embodiment 6

Figure 13:
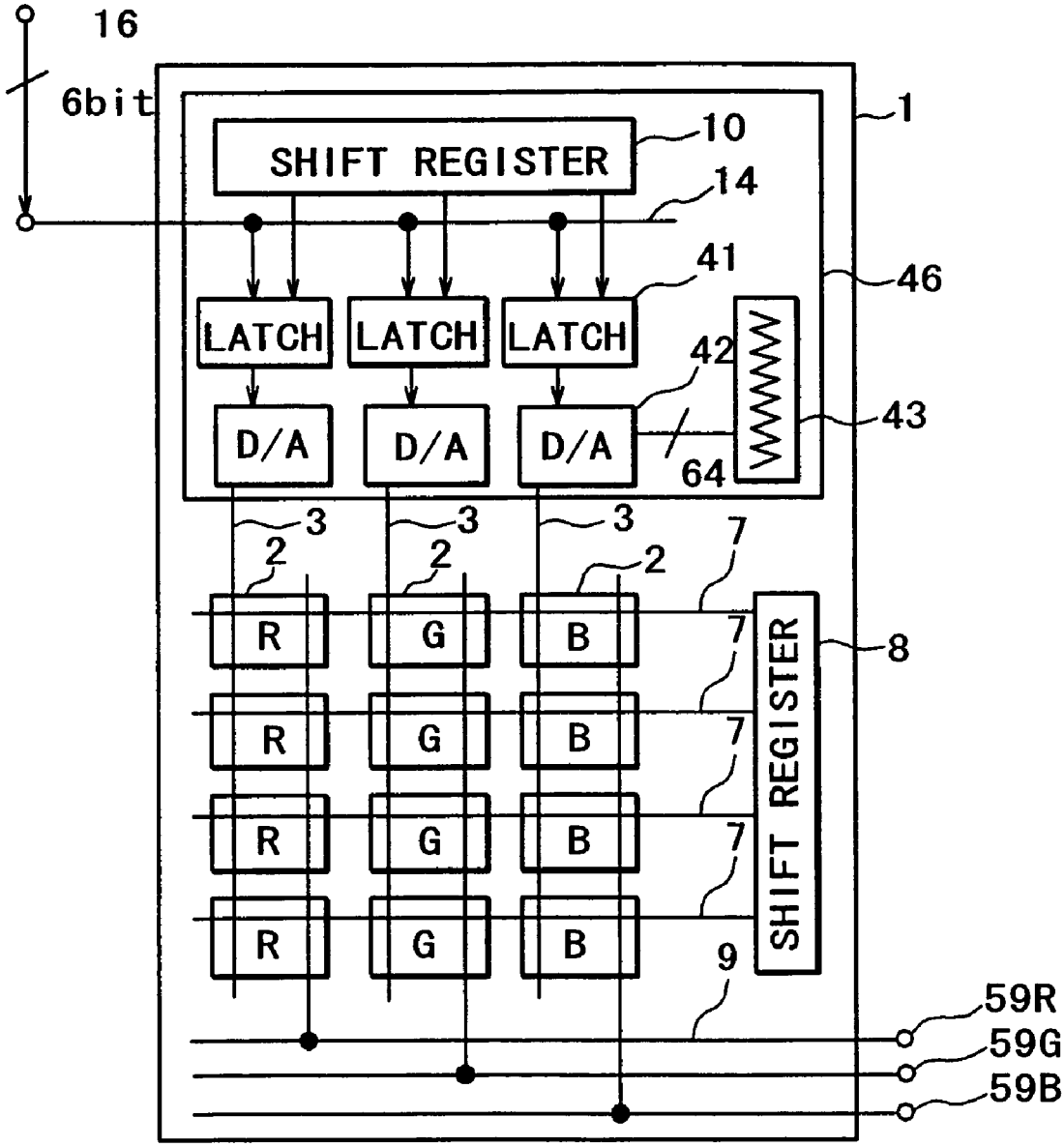
FIG. 13 is a diagram representing a schematic circuitry structure of an organic EL display panel according to a preferred Embodiment 6 of the present invention.

Referring to FIG. 13, a preferred Embodiment 6 of the present invention is described below.

FIG. 13 is a diagram representing a schematic circuitry structure of an organic EL display panel of preferred Embodiment 6.

The overall configuration and operation of the display device circuitry of Embodiment 6 is essentially the same as that of preferred Embodiment 3, except that separate power supply lines are provided for R, G, and B pixel columns, respectively. Therefore, in the following, the overall configuration and operation of the circuitry of Embodiment 6 will not be described to avoid repetition and the description focuses on the differences from the circuitry of preferred Embodiment 3 to explain the features of preferred Embodiment 6.

As described with respect to preferred Embodiment 3, the organic EL element drive TFT 22 included in each element allows the signal current produced by the analog tone value voltage applied to its gate to flow across the organic EL element 23 and the organic EL element 23 emits light with chromaticity depending on the signal current flowing across it. In this way, light emission in a tone in accordance with the signal voltage, that is, the above-mentioned analog tone value voltage, is performed. In the circuitry of Embodiment 6, separate power supply lines 59R, 59G, and 59B to supply the source voltage to the organic EL element drive TFT 22 in each pixel are provided for R, G, and B pixel columns and different drive voltages are applied to the R, G, and B pixels. In this preferred Embodiment 6, even with the application of the same analog tone value voltage, the conditions for driving the organic EL element drive TFTs 22R, 22G, and 22B are modulated by different drive voltages on the power supply lines 59R, 59G, and 59B, and consequently, different signal currents are produced to drive the organic EL elements 23R, 23G, and 23B, respectively. Thereby, the circuitry of Embodiment 6 alleviates the difference in the light emission characteristics of the R, G, and B organic EL elements 23 and enables display in a consistent color temperature scale and desired colors, independent of the input digital pixel data values. The advantage of preferred Embodiment 6 is that the signal current flows across each organic EL element 23, that is, luminance, can be changed only by changing the drive voltages on the power supply lines 59R, 59G, and 59B from the external. However, because the signal currents to flow across the R, G, and B organic EL elements 23 are simply adjustable, Embodiment 6 is unable to compensate for subtle differences in the characteristic curves of light emission by the R, G, and B organic EL elements. It is preferable to combine preferred Embodiment 6 with other means such as preferred Embodiments 1 and 2.

Embodiment 7

Figure 14:
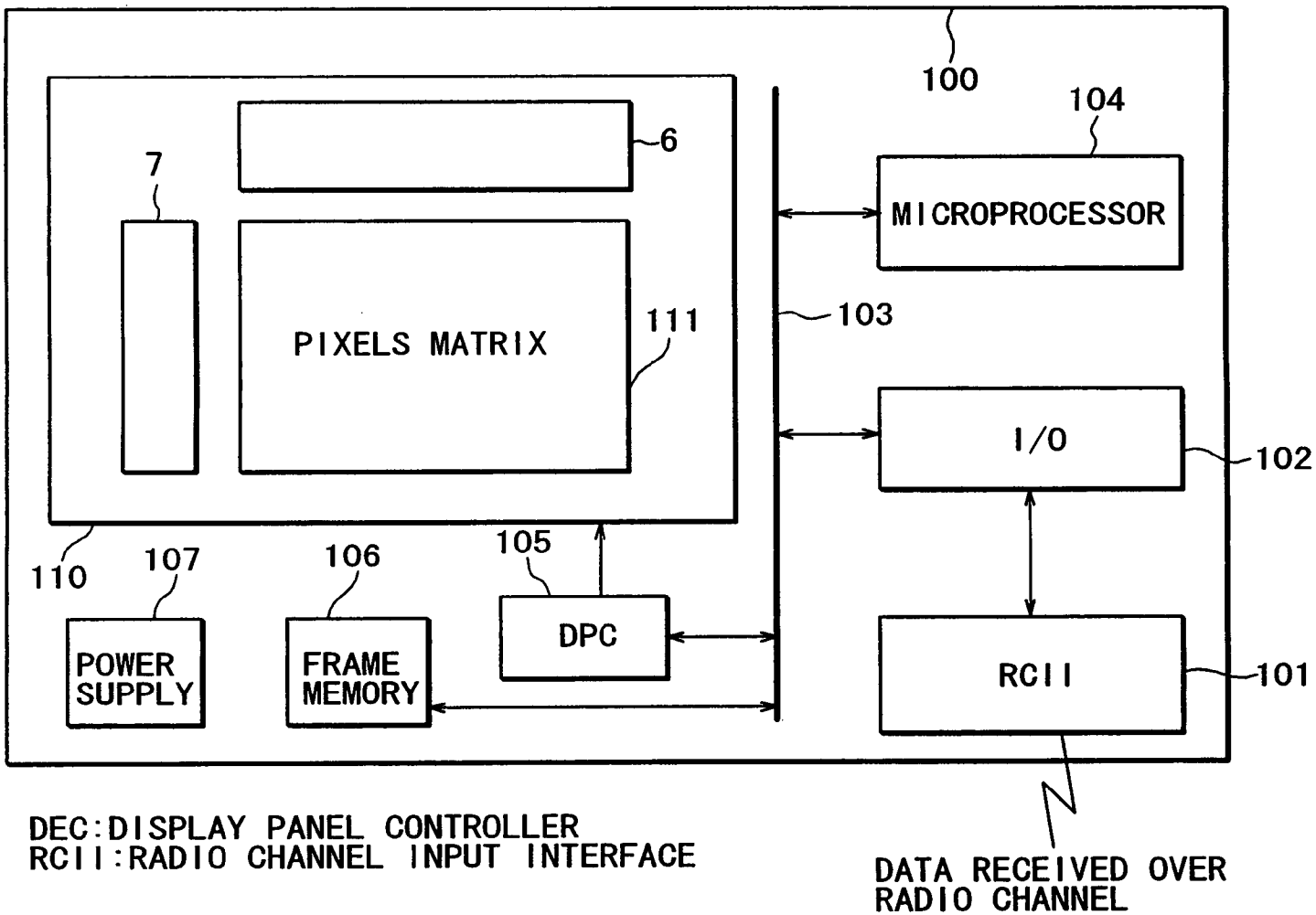
FIG. 14 is a diagram representing a motion picture reproducer configuration according to a preferred Embodiment 7 of the present invention.
Figure 15:
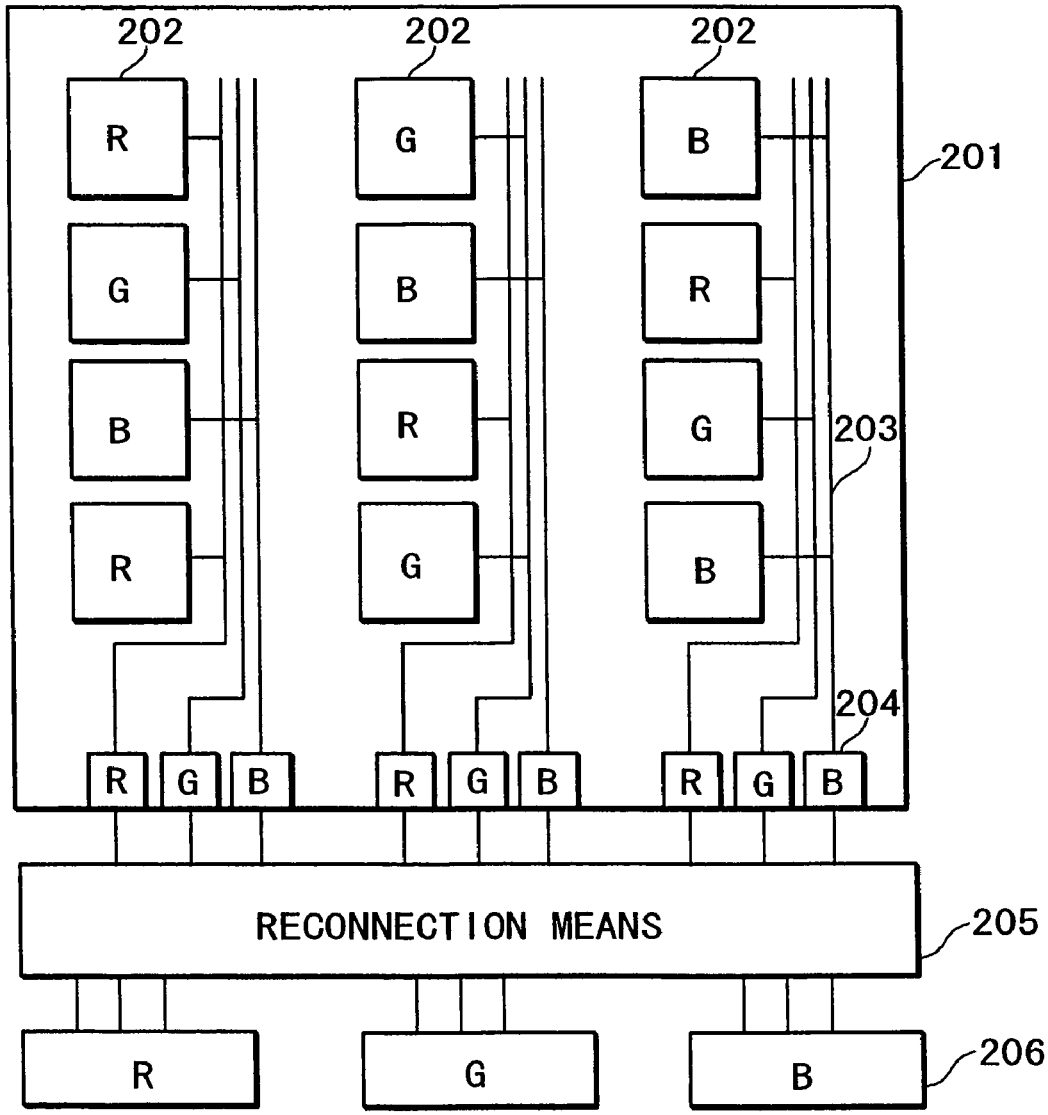
PRIOR ART FIG. 15
FIG. 15 is a simple matrix type organic EL display according to prior art.

Referring to FIG. 14, a preferred Embodiment 7 of the present invention is described below.

FIG. 14 is a diagram representing the configuration of a motion picture (digital television) reproducer 100 of Embodiment 7.

To a radio channel input interface circuit 101, text data and compressed picture data or the like as motion picture data based on the MPEG standards are input. The output of the radio channel input interface circuit 101 is connected to a data bus 103 via an input/output (I/O) circuit 102. To the data bus 103, other components including a microprocessor 104, which decodes MPEG signals and exerts control, a display panel controller 105 in which a D-A converter is incorporated, and a frame memory 106 are connected. The output of the display panel controller 105 is input to an organic EL display panel 110 that comprises a pixels matrix 111, a shift register 7, an analog signal drive circuit 6, and other electronics. The motion picture reproducer 100 further includes a secondary power supply 107. The organic EL display panel 110 has the same circuitry and operates in the same way as the organic EL display panel built on the glass substrate 1 described hereinbefore with respect to Embodiment 1, and therefore, the description of its circuitry and operation are not repeated.

The operation of the motion picture reproducer of preferred Embodiment 7 is described below. The radio channel input interface circuit 101 first receives compressed picture data or the like from the external and transfers this data via the I/O circuit 102 to the microprocessor 104 and the frame memory 106. In response to commands entered by the user, the microprocessor 104 drives the motion picture reproducer 100, decodes the compressed picture data, performs signal processing, and displays information as required. The picture data subjected to signal processing is temporarily stored into the frame memory 106 as required.

When the microprocessor 104 issues an instruction to display something, appropriate picture data is retrieved from the frame memory 106 as required and input via the display controller 105 to the organic EL display panel 101. On the pixels matrix 111, a series of pictures from the input picture data is displayed in real time. The display panel controller 105 outputs predetermined timing pulses required for displaying a series of pictures in real time. According to the present invention, the 6-bit picture data for individual R, G, and B pixels is stored in the frame memory 106 and this digital pixel data is once converted into 8-bit digital data for individual R, G, and B pixels by the microprocessor 104. Then, the 8-bit digital pixel data is input to the organic EL display panel 110. In preferred Embodiment 7, the microprocessor 104 also fills the role of the digital pixel data conversion circuit 15 of preferred Embodiment 1 and, therefore, a dedicated hardware component like the digital pixel data conversion circuit 15 is not required. Using signals, the organic EL display panel 110 displays pictures generated from the 8-bit picture data in real time on the pixels matrix 111, according to the principles described above with respect to preferred Embodiment 1. The secondary battery 107 supplies power to drive the motion picture reproducer 100.

Based on the described configuration and operation, the motion picture reproducer of preferred Embodiment 7 enables display in a consistent color temperature scale and desired colors, independent of the digital pixel data values stored in the frame memory 106, in the same way as described above.

Also in preferred Embodiment 7, the display color temperature scale can be altered in real time by rewriting the data conversion table that is referenced by the microprocessor 104 for generating 8-bit digital data for individual R, G, and B pixels or referring to a different data conversion table. This function can be used, for example, when the display is used adaptively to the light condition in its environment or the color temperature scale is adjusted for deterioration of the organic EL elements 23. Alternatively, color temperature setting can be altered optionally for the display area for text and the display area for natural images on the display screen. If this setting is performed, in general, it is preferable to set the color temperature of the display area for text higher than that of the display area for natural images to improve the easiness to read text on the display screen.

While, also in preferred Embodiment 7, the analog signal drive circuit 6 is constructed together with the pixels matrix 111 and shift register 7, using polycrystalline Si-TFTs, the present invention is not limited to such construction. In the alternative, the peripheral circuits to the pixels such as the analog signal drive circuit 6 may be embodied in monocrystalline LSIs and mounted on the substrate. Even in the monocrystalline LSI embodiment of the analog signal drive circuit 6, it is not necessary to construct separate analog signal drive circuits 6 for R, G, and B pixels and this is obviously beneficial in view of the cost of packaging.

Although the light emission characteristics of the R, G, and B organic EL elements 23, as explained in referenced to FIG. 3, change if the material of the organic EL elements changes, it should be appreciated that application of the present invention is not restricted to specific material of the organic EL elements. While the microprocessor 104 converts 6-bit digital pixel data into 8-bit data in preferred Embodiment 7, it will be appreciated that the present invention is applicable regardless of the number of bits of the digital pixel data before and after conversion.

The foregoing invention has been described in terms of preferred embodiments. However, those skilled, in the art will recognize that many variations of such embodiments exist. Such variations are intended to be within the scope of the present invention and the appended claims.

Nothing in the above description is meant to limit the present invention to any specific materials, geometry, or orientation of elements. Many part/orientation substitutions are contemplated within the scope of the present invention and will be apparent to those skilled in the art. The embodiments described herein were presented by way of example only and should not be used to limit the scope of the invention.

Although the invention has been described in terms of particular embodiments in an application, one of ordinary skill in the art, in light of the teachings herein, can generate additional embodiments and modifications without departing from the spirit of, or exceeding the scope of, the claimed invention. Accordingly, it is understood that the drawings and the descriptions herein are proffered by way of example only to facilitate comprehension of the invention and should not be construed to limit the scope thereof.

What is claimed is:

1. An image display device comprising:

a display portion which comprises a group of pixels of two or more types, each pixel including a diode for emitting light whose primary wavelength is specific to the type of the pixel;

means for generating analog pixel signals to be input to the group of pixels, said means for generating analog pixel signals comprising performing a first conversion of input digital pixel data into output digital pixel data in accordance with a type of each pixel and a second conversion of the output digital pixel data into the analog pixels signals that is separate from the first conversion and independent of the type of each pixel, the output digital pixel data comprising more bits than the input digital data; and switch for inputting the analog pixel signals to the group of pixels, each pixel including light emission driving driver for driving said diode for emitting light according to the analog pixel signal written in the pixel, wherein said light emission driving driver drives each of said diode for emitting light with a drive current, selected from a group of different drive currents, appropriate for each type pixel, wherein a quantity of tone values used for display is equal in the input digital pixel data and the output digital pixel data.

2. An image display device according to claim 1, wherein said diode for emitting light is an organic light emitting diode element.

3. An image display device according to claim 1, wherein said circuit for generating analog pixel signals is built on an insulating substrate, using polycrystalline Si-TFTs.

4. An image display device according to claim 1, wherein said circuit for generating analog pixel signals is constructed in one or more monocrystalline Si-LSIs and mounted on an insulating substrate.

5. An image display device according to claim 1, wherein said drive current is generated by a polycrystalline Si-TFT in said light emission driving driver and the polycrystalline Si-TFTs of at least two pixels of different types have different ratios of gate width to gate length=WL appropriate for each type of pixel.

6. An image display device according to claim 1, wherein said drive current is generated by a polycrystalline Si-TFT in said light emission driving driver and the polycrystalline Si-TFTs of at least two pixels of different types have different resistances appropriate for each type of pixel.

7. An image display device according to claim 1, wherein said drive current is generated by a polycrystalline Si-TFT in said light emission driving driver and, to the polycrystalline Si-TFTs of at least two pixels of different types, different source voltages are applied that are appropriate for each type of pixel.

* * * * *